US005171202A

United States Patent [19]

Su

[11] Patent Number: 5,171,202

[45] Date of Patent: Dec. 15, 1992

[54] AUTOMATIC MACHINE FOR MAKING ACCORDION DATA POCKETS

[76] Inventor: Ken J. Su, 102, Lane 52, Fu-Teh Road, Su Wang Village, Ta Li Hsian, Taichung Hsien, Taiwan

[21] Appl. No.: 821,820

[22] Filed: Jan. 17, 1992

[51] Int. Cl.[5] ..... B31B 45/00; B31B 41/64; B31B 11/64

[52] U.S. Cl. ..... 493/189; 493/210; 493/451; 493/918; 493/947

[58] Field of Search ..... 493/189, 198, 210, 243, 493/386, 391, 451, 918, 940, 947

[56] References Cited

U.S. PATENT DOCUMENTS

| | | | |
|---|---|---|---|
| 1,968,165 | 7/1934 | Olm | 493/220 |
| 4,425,111 | 1/1984 | Chazelas | 493/918 |
| 4,540,390 | 9/1985 | Thorschmidt | 493/23 |
| 4,764,159 | 8/1988 | Mitsuyama | 493/189 |

*Primary Examiner*—William E. Terrell
*Attorney, Agent, or Firm*—Larson and Taylor

[57] ABSTRACT

The present invention provides an automatic machine for making accordion data pockets, especially an automatic machine which is capable of bonding the inner leaf members, side cover members, and bottom member of an accordion data pocket together in one step. The machine is characterized by a fixed and a movable die seats, a top press die, two side press dies, two side boards, etc. The movable die seat has a plurality of cavities formed on its top surface, allowing index holders provided on each inner leaf member of the data pocket to insert in, and a plurality of properly and equally spaced partition plates vertically erected thereon. The fixed die seat has a plurality of properly and equally spaced positioning plates vertically erected thereon and each of the positioning plates has chamfers formed at its one vertical side and its top horizontal side. After the already molded plastic leaf members, cover members and bottom member of the data pocket are separately positioned in place, the machine is switched on to move the movable die seat and press dies to heat seal and thereby bonds these components in one step and effectively produces a complete accordion data pocket.

1 Claim, 6 Drawing Sheets

AUTOMATIC MACHINE FOR MAKING ACCORDION DATA POCKETS

BACKGROUND OF THE INVENTION

The present invention relates to an automatic machine for making accordion data pockets, more particularly to an improved automatic machine for making accordion date pockets which can bond the inner leaf members, side cover members, and bottom member of an accordion date pocket together in one single process.

As shown in FIG. 1, a general accordion data pocket mainly consists of a plurality of inner leaf members 10, two side cover members 11, and a bottom member 12. Presently, the method to make such accordion data pockets basically includes two steps. The first step is to separately form each part of the inner leaf members, side cover members, and bottom member and the second step is to bond these parts with an automatic machine for this purpose. However, existing automatic heat sealing machines used in the second step can only bond the inner leaf members 10 and the side cover members 11 as shown in FIG. 2. As to the bonding of bottom member 12 to the partly completed pocket, another process is required. This two-stage bonding requires longer manufacture cycle and higher cost, and is inconvenient in operation and labor consuming, all of these largely reduce the efficiency in manufacturing such accordion data pockets.

It is therefore tried by the applicant to develop an improved machine for making accordion data pockets which can eliminate the drawbacks existed in conventional accordion data pocket making machines.

SUMMARY OF THE INVENTION

It is a primary object of the present invention to provide an automatic machine which can complete the bonding of the inner leaf members, side cover members, and bottom member of an accordion data pocket in just one single step so as to highly upgrade the efficiency in producing such pockets with lesser labor, time and cost.

BRIEF DESCRIPTION OF THE DRAWINGS

The above-mentioned object of the present invention, the technical means used to achieve the object, and other characteristics of the present invention can be further understood by referring to the following detailed description of the preferred embodiment and the accompanying drawings, wherein.

DETAILED DESCRIPTION OF THE PREFERRED EMBODIMENTS

Figure 1:
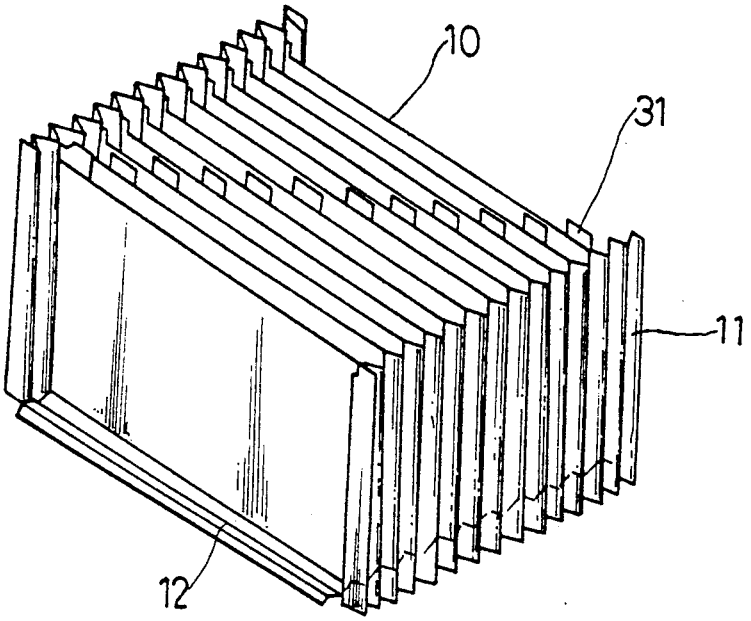
FIG. 1 is a three-dimensional perspective of a general accordion data pocket to be completed with the present invention.
Figure 2:
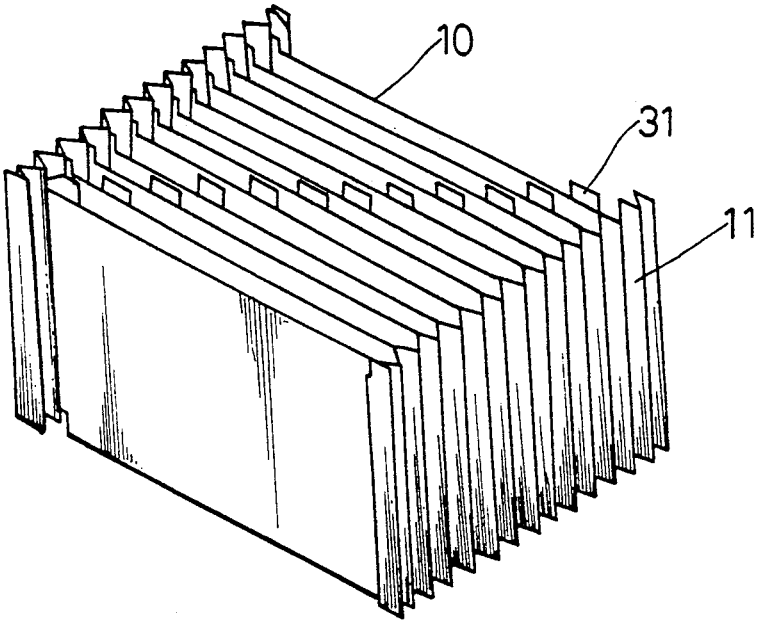
FIG. 2 shows a partly completed accordion data pocket wherein only the inner leaf members and the side cover members are bonded together.
Figure 3:
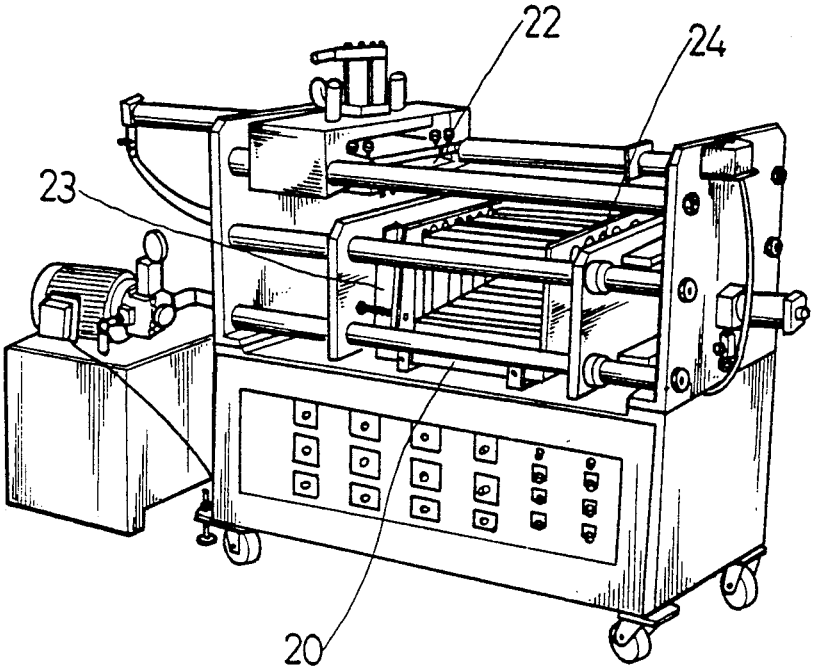
FIG. 3 is a three-dimensional perspective of the automatic machine according to the present invention used to bond the members of an accordion data pocket.

Please refer to FIGS. 3 through 6, the present invention is characterized by a fixed die seat 20, a movable die seat 21, a top press die 22, side press dies 23, 24, side boards 25, 26, etc. The movable die seat 21 has a plurality of cavities 30 formed at predetermined positions, each of the cavities 30 allows an index holder 31 provided on an inner leaf member 10 of an accordion data pocket to insert and be fixed therein. Partition plates 32 are vertically erected on the movable die seat 21 at proper and equal interval. The fixed die seat 20 is fixed to the bed of machine according to the present invention, and has a plurality of positioning plates 33 vertically erected thereon at proper and equal interval corresponding to that used by the partition plates 32. Each of the positioning plates 33 has chamfers separately formed at a vertical side A and a top horizontal side B. The top press die 22 is fixed to an upper slide guide 27 and the side press dies 23, 24 are separately fixed to two side slide guides 28, 29. All the slide guides 27, 28, 29 are controlled by oil pressure cylinders. On the side boards 25, 26, a plurality of long slots 34 are longitudinally and parallelly formed to allow press blocks on the side press dies 23, 24 to pass through.

Figure 4:
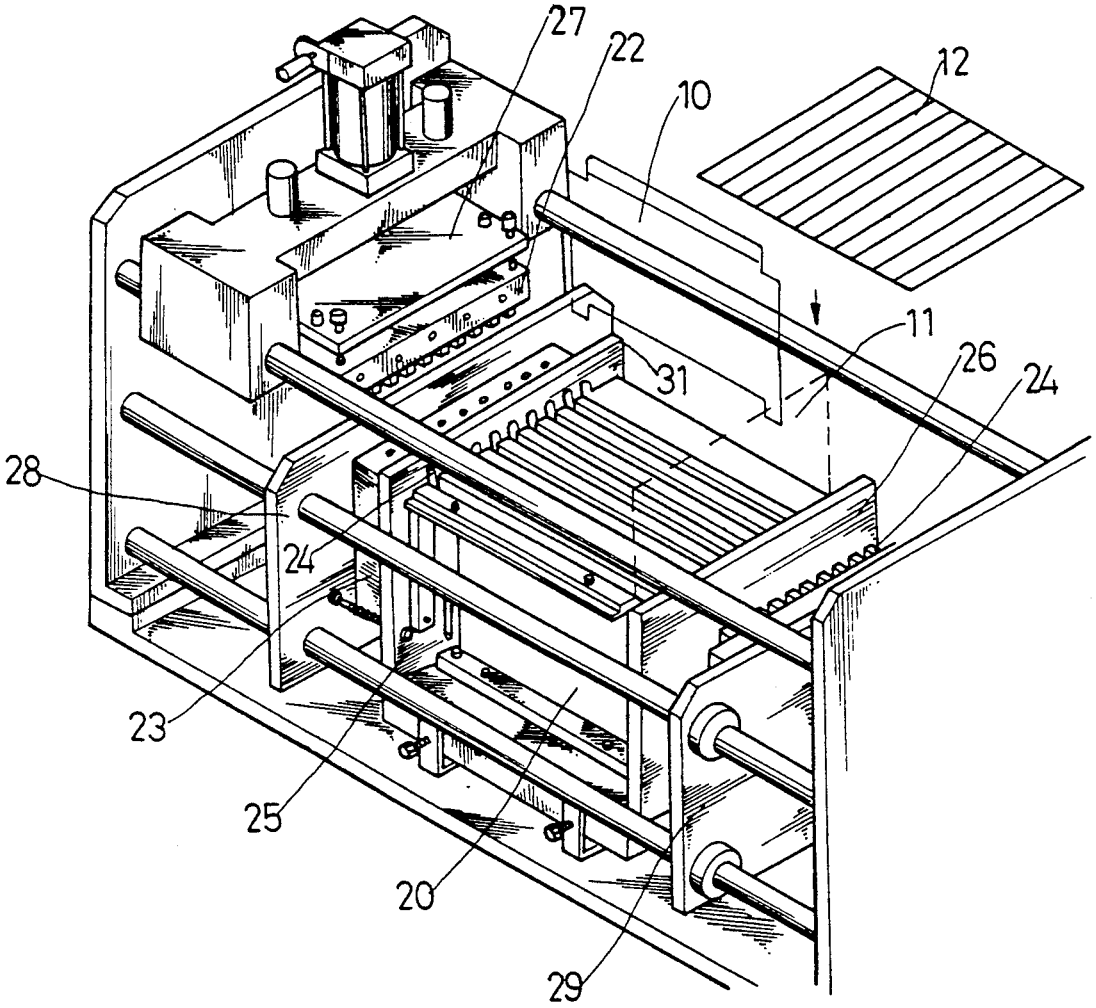
FIG. 4 illustrates positions of the inner leaf members, side cover members, and bottom member of an accordion data pocket in the machine according to the invention before they are to be bonded.
Figure 5:
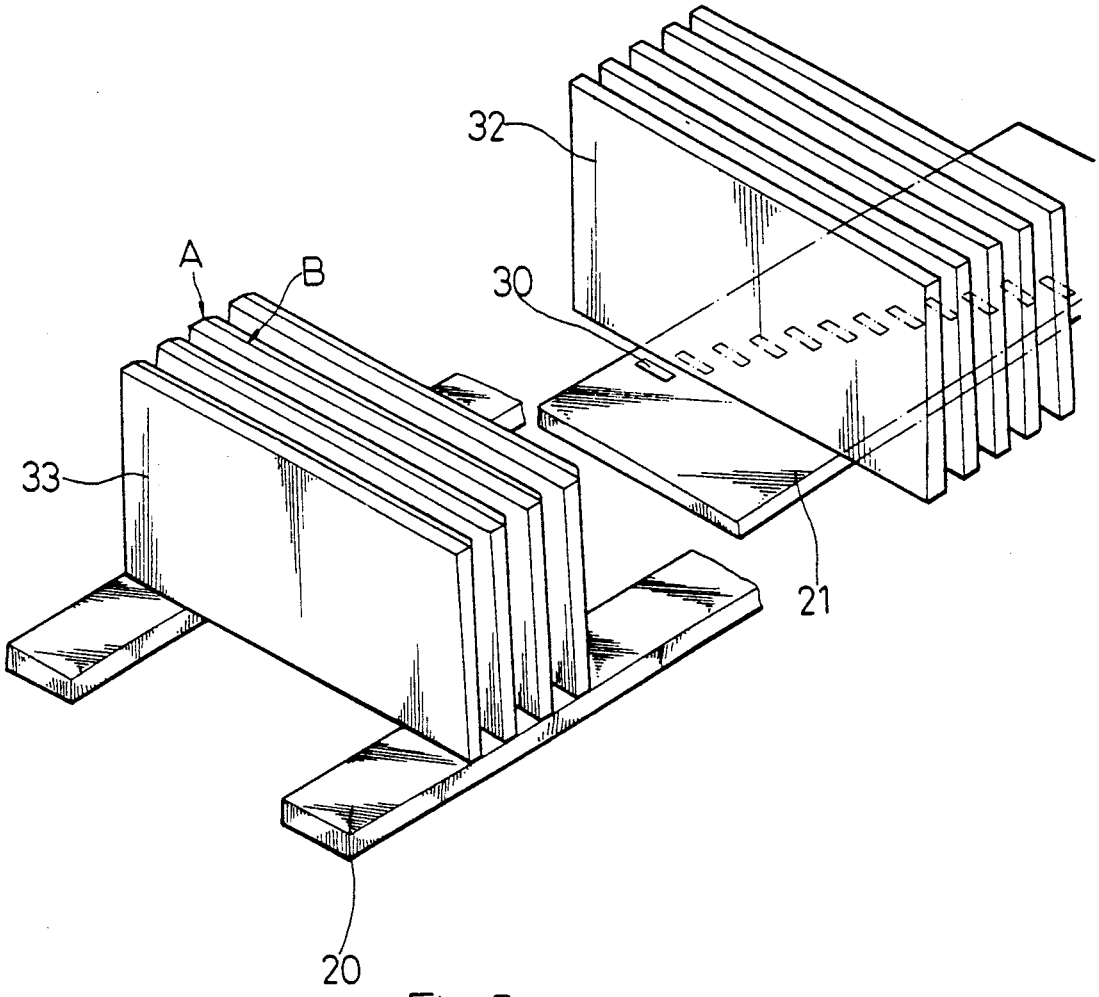
FIG. 5 is a three-dimensional analytical perspective showing the fixed die seat and the movable die seat of the present invention.
Figure 6:
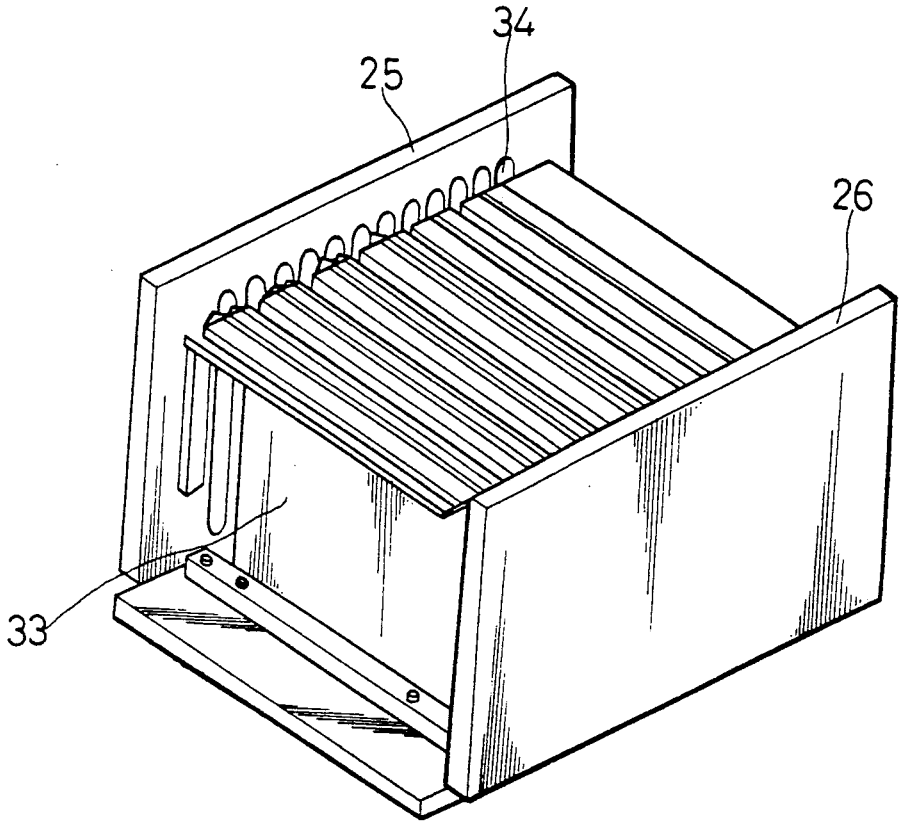
FIG. 6 is a three-dimensional perspective showing an assemblage of the fixed die seat and the movable die seat having been held in place.

As shown in FIG. 4, the inner leaf members 10, side cover members 11, and the bottom member 12 are separately positioned in place before the press and bond starts. Each of the inner leaf members 10 is inserted into a gap formed by and between a partition plate 32 on the movable die seat 21 and a positioning plate 33 on the fixed die seat 20 in such a manner that the index holder 31 on each inner leaf member 10 is just received by one cavity 30 on the movable die seat 21 and the top and two side portions of each inner leaf member for folding extend out of the partition plates 32 and the positioning plates 33. The side cover members 11 are separately positioned between a side board 25 or 26 and the assembled fixed and movable die seats. The bottom member 12 is positioned on top of the assembled fixed and movable die seats.

When all the plastic members are positioned in place, the power switch of the machine is switched on, causing the movable die seat 21 to move so that the partition plates 32 thereon tightly contact the positioning plates 33 on the fixed die seat 20. At this point, the inner leaf members 10 separately inserted between each pair of the partition plate 32 and the positioning plate 33 are firmly clamped and held therein, causing their top and side folding portions to contact the positioning plates 33 and attach to the sides having chamfers formed thereat.

The power switch is switched on again, causing the top press die 22, side press dies 23, 24 to operate and press under control of the oil pressure cylinders. The toothed steel press dies 22, 23, 24 are heated, and the oil pressure cylinders transit pressure, and the accordion data pocket members are heat-sealed and bonded at their left, right and top sides for a preset time period. After the press, a complete accordion data pocket with inner leaf members, two side cover members, and a bottom member is efficiently formed in one step. The labor, time and cost required to produce such accordion data pockets are largely saved.

What is claimed is:

1. An automatic machine for making accordion data pockets mainly comprising:

a fixed die seat having a plurality of properly and equally spaced positioning plates vertically erected thereon;

said positioning plates each having chamfers separately formed at its one vertical side and its top horizontal side;

a movable die seat having a plurality of properly and equally spaced partition plates vertically erected thereon, corresponding to said positioning plates on said fixed die seat, and a plurality of cavities formed on top surface thereof;

a top press die fixed to an upper slide guide fixedly installed on said machine;

two side press dies separately fixed to a left and a right slide guide fixedly installed on said machine;

two side boards separately located at two outer sides of said fixed and said movable die seats and having long slots longitudinally and parallelly formed thereon; and multiple sets of oil pressure cylinders for separately controlling movement of said movable die seat, said side press dies and said top press die;

each of said partition plates together with a said positioning plate adjacent thereto forming a gap between them, allowing a leaf member which is a part of an accordion data pocket to insert therein with an index holder provided on said leaf member facing downward and inserted into one of said cavities on said movable die seat;

each of said side press dies together with said positioning and said partition plates forming a gap between them, allowing a side cover member which is a part of an accordion data pocket to insert therein;

on top of said positioning and said partition plates, a bottom member which is a part of an accordion data pocket being allowable to be positioned; and when said oil pressure cylinders being separately switched on to move said movable die seat, said side press dies, and said top press die, said inserted leaf members, said side cover members, and said bottom member used to make an accordion data pocket are simultaneously and effectively heat sealed and bonded together at proper positions in one step which obviously largely reduces labor, time, and cost to make an accordion data pocket.

* * * * *